US006868566B2

(12) United States Patent
Gatten

(10) Patent No.: US 6,868,566 B2
(45) Date of Patent: Mar. 22, 2005

(54) SWADDLING BLANKET

(76) Inventor: Michael Dean Gatten, 2810 White Ridge Pl. #11, Thousand Oaks, CA (US) 91362

( * ) Notice: Subject to any disclaimer, the term of this patent is extended or adjusted under 35 U.S.C. 154(b) by 0 days.

(21) Appl. No.: 10/622,705

(22) Filed: Jul. 21, 2003

(65) Prior Publication Data

US 2004/0019969 A1 Feb. 5, 2004

Related U.S. Application Data

(60) Provisional application No. 60/399,679, filed on Jul. 31, 2002.

(51) Int. Cl.[7] ..... A47G 9/08

(52) U.S. Cl. ..... 5/494; 5/413 R; 5/655; 2/69

(58) Field of Search ..... 2/69, 69.5; 5/413 R, 5/494, 655

(56) References Cited

U.S. PATENT DOCUMENTS

| | | | | | |
|---|---|---|---|---|---|
| 1,584,853 | A | * | 5/1926 | Dern | 2/69 |
| 5,046,204 | A | * | 9/1991 | Mohler | 5/413 R |
| 5,058,226 | A | * | 10/1991 | Crosby | 5/494 |
| 5,611,095 | A | * | 3/1997 | Schneider | 5/482 |
| 5,722,094 | A | * | 3/1998 | Ruefer | 2/69.5 |
| 5,852,827 | A | * | 12/1998 | Lear | 2/69.5 |
| 6,393,612 | B1 | | 5/2002 | Thach | |
| 6,640,340 | B2 | * | 11/2003 | Gibson | 2/69.5 |
| 6,662,390 | B1 | * | 12/2003 | Berger | 5/486 |

FOREIGN PATENT DOCUMENTS

| | | |
|---|---|---|
| WO | WO 02/00048 A1 | 1/2002 |
| WO | WO 02/087369 A1 | 11/2002 |

OTHER PUBLICATIONS

Gerard, Claudia M., Spontaneous Arousals in Supine Infants White Swaddled and Unswaddled During Rapid Eye Movement and Quiet Sleep, Pediatrics, Dec. 2002, vol. 110, No. 6.

Thach, Bradley Terrill, Causes of Sudden Infant Death Syndrome: Human and Animal Research, Web Page [Online], Washington University in St. Louis. Original publication date unknown [retrieved Sep. 27, 2002]. Retrieved from the Internet. <URL: http://research.medicine.wustl.edu/ocfr/research.nsf/c517b7f273394130862567970055bff2/ee744c3f0a b9df148625677d005940df?OpenDocument>.

Grant, Ross, Swaddled Infants Sleep Better, Safer, Health Scout News. Web Page [Online], TeachMoreLoveMore website. Dec. 6, 2002. Retrieved from the internet. <URL: http://www.teachmorelovemore.org/ArticlesDetails.asp?articleid=4525>.

(List continued on next page.)

*Primary Examiner*—Michael Trettel
(74) *Attorney, Agent, or Firm*—Bruce E. Weir

(57) ABSTRACT

A swaddling blanket to alleviate colic has a back panel long enough to support a child from neck to feet, a leg pouch to loosely contain the child's legs, arm restraints to hold the child's arms against and parallel to the child's torso, a tapered short blanket arm to wrap over the child, and a tapered long blanket arm to wrap around the child more than once from the opposite direction to provide comforting pressure around the child's arms and torso.

16 Claims, 5 Drawing Sheets

OTHER PUBLICATIONS

Author Unknown, Swaddling may cut SIDS risk, Web Page [Online], Babycenter.com website. Sep. 16, 2002, Retrieved from the internet. <URL: http://www.babycenter.com/refcap/419.html>.

Geller, David, Should I swaddle my baby? Web Page [Online], Babycenter.com website. Original publication date unknown. Retrieved from the internet. <URL: http://www.babycenter.com/expert/10010.html>.

Lin–Dyken, Deborah, What is "swaddling"? What are the pros and cons? Web Page [Online], Original publication date unknown. Rerieved from the Internet. <URL: http://www.babycenter.com/expert/7660.html>.

The Baby Center Editorial Staff, What does it mean to swaddle a baby?, Web Page [Online], Original publication date unknown. [retrieved Sep. 27, 2000], Retrieved from the Internet. <URL: http://www.babycenter.com/refcap/baby/newborns/125.html>.

Knosp, Laura K., Neonatal Pain and Touch, Web Page [Online], publication date unknown [retrieved Sep. 30, 2002]. Retrieved from the internet. <URL: http://www.nursing.uiowa.edu/sites/PedsPain/Nonpharm/Touchnt.htm>.

Author Unknown, Swaddling Babies May Reduce Cot Death Risks, Web Page [Online], Oct. 15, 2002. Retrieved from the Internet. <URL: http://www.babyworld.co.uk/news/Oct02/151002 cotdeath.asp>.

Author Unknown, Swaddling May Help Sleeping Babies Remain On Their Backs, Reducing Risk of Sudden Infant Death Syndrome, Web Page [Online], Healthworld Online. Dec. 2, 2002. Retrieved from the internet. <URL: http://www.sciencedaily.com/releases/2002/12/021202072217.htm>.

Author Unknown, Swaddling May Help to Prevent SIDS, Web Page [Online], Original publication date unknown [retrieved Sep. 27, 2002]. Retrieved from the internet. <URL: http://www.advanceformrc.com/MRdnw.html>.

Ezell, Cheryl, SIDS: Sudden and Silent, Web Page [Online], KidsHealth Website. Original publication date unknown [retrieved Dec. 11, 2002]. Retrieved from the Internet. <URL: http://ssw.unc.edu/fcrp/fp/fp_vol2no1/sudden_and_silent.htm>.

Sobells, Laura, Comment for Auto–responder calming tips, E–mail response from www.calmbaby.com. Nov. 3, 2002. Retrieved from the Internet. <URL: http://www.calmbaby.com>.

Author Unknown, Doctors at St. Louis Children's Hospital Suggest Swaddling To Prevent SIDS, Web Page [Online], St. Louis Children's Hospital Website. Oct. 10, 2002. Retrieved from the Internet. <URL: http://www.stiouischildrens.org/articles/media.asp?ID=1028>.

Turbo, Richard, Quieting Colic, Web Page [Online], Murphy Sam & Jodi website. Original publication date unknown [retrieved Sep. 30, 2002]. Retrieved from the Internet. <URL: http://www.murphysamandjodi.com/content–quietingcolic.htm>.

Author Unknown, The Infant Swaddler, Web Page [Online], Comfort Silkie Store website. Original publication date unknown [retrieved Dec. 11, 2002], Retrieved from the Internet. <URL: http://www.newcenturystyle.com/comfortsilkie.htm>.

Author Unknown, Name Unknown, Web Page [Online], Image of swaddling garment. Original publication date unknown [retrieved Oct. 9, 2002], Retrieved from the Internet. <URL: http://store/alpdev.com/store9/images/164.jpg>.

Author Unknown, Name Unknown, Web Page [Online], Image of swaddling garment. Original publication date unknown [retrieved Oct. 9, 2002], Retrieved from the Internet. <URL: http://www.felogroup.com/eng product/bd.htm>.

Author Unknown, CuddleBug Cloverleaf Blankets, Web Page [Online], Sweet Pea Company website. Original publication date unknown [retrieved Oct. 9, 2002], Retrieved from the Internet <URL: http://www.sweetpeacompany.com/html/cloverleaf blankets.html>.

Author Unknown, Shop the Shops Online: Kidstuff: Infants and Toddlers, Web Page [Online], Shop the Shops website. Original publication date unknown [retrieved Oct. 9, 2002], Retrieved from the Internet. <URL: http://www.shoptheshops.com?Deptsub KSI newbBurp.asp>.

Author Unknown, Silkie Swaddling Blanket, Web Page [Online], SilkieSmoother website. Original publication date unknown [retrieved Oct. 9 , 2002], Retrieved from the Internet. <URL: http://www.silkiesmoother.com/silkie swaddling blanket.html>.

Author Unknown, Cozy Swaddling Wrap, Web Page [Online], Image of swaddling garment. Original publication date unknown [retrieved Oct. 9, 2002], Retrieved from the Internet. <URL: http://www.kozykidscompany.com/kozy wraps.html>.

Author Unknown, Swaddlema Blanket, Web Page [Online], Image of swaddling garment. Original publication date unknown [retrieved Oct. 9, 2002], Retrieved from the Internet. <URL: http://www.greatbabyproducts.com/blanketswaddleopen.jpg.>.

Author Unknown, Huggabebe, Web Page [Online]. Original publication date unknown [retrieved Apr. 30, 2002], Retrieved from the Internet. <URL: http://www.huggabebe.com>.

* cited by examiner

SWADDLING BLANKET

CROSS-REFERENCE TO RELATED APPLICATION

This application claims the benefit of U.S. provisional patent application Ser. No. 60/399,679, filed by the same inventor on Jul. 31, 2002, now pending.

BACKGROUND

The swaddling of infants has been practiced since antiquity by people around the world. Swaddling protects an infant from the surrounding environment, allows a caregiver to handle and carry an infant more easily, and has long been thought to comfort and quiet an infant.

This is especially true of "colicky" infants, those who cry at least three hours a day, three days a week, for at least three weeks in a row. Although no specific cause for colic has been identified and many potential remedies have been offered, research has shown that effective swaddling often has a calming effect on crying infants. Research also shows that a swaddled infant tends to be more willing to sleep on her back, which significantly reduces her vulnerability to Sudden Infant Death Syndrome.

The key to effective swaddling appears to reside in a combination of factors. Loosely-swaddled infants tend to be more restless than snugly-swaddled infants, but overly tight swaddling may inhibit breathing. An infant is comforted by having her arms held snugly against her midsection and by having even pressure applied around her torso. Limitations on leg movement help also, but complete immobilization of the legs may promote hip dysplasia. Any pressure against the head is counterproductive. Too thin a wrap may provide inadequate restraint, but too heavy a wrap may overheat the infant.

It is thought that gentle, even pressure around an infant's torso and immobilization of her limbs may simulate the pre-birth environment. Additionally, or alternatively, immobilization of the limbs may keep an infant from startling herself awake by reflexively flailing her limbs in her sleep and striking nearby objects. Pressure against the head is thought to awaken an infant by stimulating the "rooting" response, where the infant reflexively seeks a nipple.

An ideal swaddling implement would therefore provide a means for immobilizing an infant's arms while placing gentle, even pressure on her torso; would restrict leg movement without excessive pressure; and would leave the infant's head unencumbered. In addition, the implement could be made of light fabric so that the infant would not overheat. The implement would be easy to use, allowing a quick, snug wrap without complex folding and tucking.

Unfortunately, presently-available swaddling implements do not provide all of these features. Few people know how to securely and properly wrap an infant in a conventional blanket, and fewer still have the inclination to learn. The traditional "colic band," a fabric strip that is wrapped around an infant's midsection, may provide some relief but does not properly contain the infant's arms and legs. Other available swaddling implements may be too loose to provide more than insulation, or too may be tight around the legs, or may have a hood that triggers the rooting response.

SUMMARY

The present invention remedies the defects of known swaddling implements, providing an easy-to-use swaddling blanket that immobilizes an infant's arms while placing gentle, even pressure on her torso, restricting leg movement without excessive pressure, and leaving the infant's head unencumbered.

A preferred embodiment of the present invention has a back panel, a leg pouch, two arm restraints, and two blanket arms, and is made from any of a variety of fabrics. The back panel is both wide and long enough to support an infant from her neck to her feet.

The leg pouch is formed from a roughly rectangular piece of fabric that is sewn to the back panel along three adjacent edges, with the bottom edge of the leg pouch sewn to the bottom edge of the back panel and the top edge of the leg pouch open. Each arm restraint is a tapered flap attached to the back panel with a seam that is beneath and parallel to an infant's arms when she is laid on her back on the back panel. Each arm restraint is positioned so that it may be wrapped inward around the adjacent arm.

In this embodiment, each blanket arm is a side extension of the back panel and tapers to a broadly-rounded point. The back panel and the blanket arms may form a single, continuous piece of material, or the blanket arms may be attached to the sides of the back panel. One blanket arm is just long enough to wrap once over an infant and be tucked partially beneath the infant. The other blanket arm extends from the opposite side of the back panel and is long enough to wrap around the infant more than once. The taper of each blanket arm is such that when both blanket arms are wrapped around the infant, most of the blanket's bulk and pressure surround the infant's torso.

To swaddle an infant with the present invention, the infant is placed on her back on the back panel, with her legs in the leg pouch and her shoulders just below the top edge of the back panel. Her arms are placed along her sides. An arm restraint is wrapped around each arm from the outside of each arm, first passing over an arm, then inward to be tucked under the arm. The shortest of the two blanket arms is wrapped over and across the infant and its tapered end is tucked under the armpit on the side of the longest blanket arm. The longest blanket arm is then wrapped snugly and repeatedly around the infant in the opposite direction.

When an infant is swaddled in this manner, her legs are contained without being immobilized and she is comforted by having her arms and torso snugly wrapped. Nothing contacts her head to provoke a rooting response. The blanket material may be light, so that she does not overheat, or it may provide insulation for colder weather. Unlike a conventional blanket, the arm restraints and tapered blanket arms of the present invention allow a caregiver to quickly and securely wrap an infant with the exact amount of pressure desired, without having the swaddling unravel when the infant moves.

Some of the benefits of the present invention may be obtained with a simplified embodiment consisting only of the back panel and tapered long blanket arm, which may form a single, continuous sheet of material. The dimensions of the back panel and the taper of the long blanket arm allow a more complete wrap and better pressure distribution than does the traditional colic band.

However, addition of a leg pouch protects the infant's feet, simplifies positioning of the infant, and improves containment of the infant's legs. Addition of the arm restraints allows a caregiver to quickly secure an infant's arms close and parallel to the infant's torso. Addition of the short blanket arm allows a caregiver to quickly secure the top edge of the leg pouch and the infant so that the long blanket arm may be easily and carefully wrapped to obtain exactly the desired pressure distribution.

All of these features and advantages of the present invention, and more, are illustrated below in the drawings and detailed description that follows.

DETAILED DESCRIPTION

Figure 1:
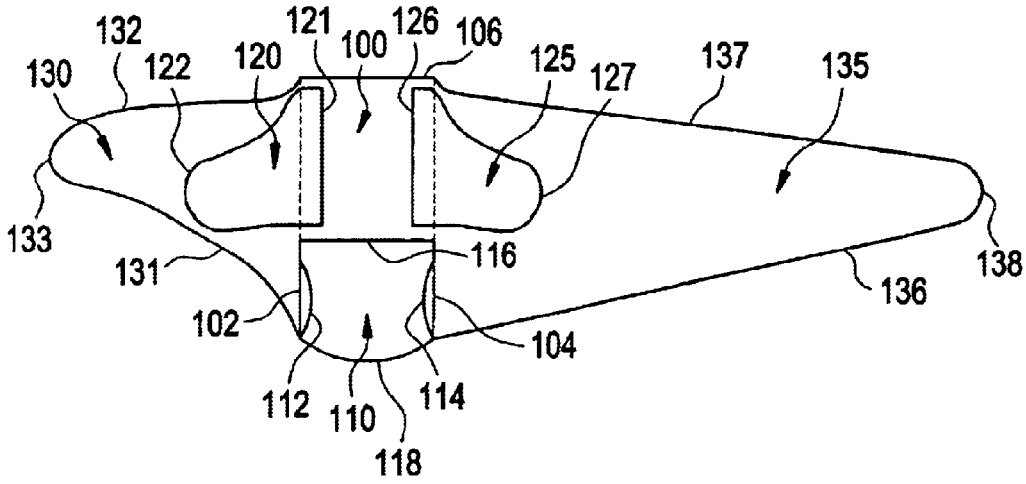
FIG. 1 shows a preferred embodiment of the present invention.

FIG. 1 shows a preferred embodiment of the present invention having a back panel 100, a leg pouch 110, a first arm restraint 120, a second arm restraint 125, a short blanket arm 130, and a long blanket arm 135. In this embodiment the back panel 100 is approximately as long and wide as the combined torso and legs of a typical infant. In this preferred embodiment, the back panel 100 measures approximately 60 cm by 25 cm. However, the back panel 100 and other parts of the invention can be scaled to fit a person of any size.

The parts of the present invention are made from sheet material, usually fabric. Some fabrics used are cotton flannel, SPANDEX®, polyester, cotton/polyester blend, ribbed cotton, elastic cotton, cotton waffle, viscose georgette, polyester georgette, rayon, satin, cotton voil, terry voil, cotton crepe, rayon crepe, shantoon, flex, linen, poplin, cambric, sheeting, denim, silk denim, knits, cotton check, cotton crepe check, silk, terry cloth, and cotton interwoven with sterling silver thread. Many other fabrics known in the art may be used instead or in addition, depending on the desired characteristics such as elasticity, warmth, weight, breathability, stain resistance, absence of allergens, visual appeal, and other factors. The present invention may be made of a single material or parts may be made of different materials. Flexible, non-fabric materials may also be used to provide special characteristics.

A short blanket arm 130 extends from a first side 102 of the back panel 100. The short blanket arm 130 tapers away from the back panel 100 to a first end point 133 and is about 40 cm long, just long enough to wrap once over an infant with enough excess length to tuck into the infant's armpit. The long blanket arm 135 extends from a second side 104 of the back panel 100. The long blanket arm 135 tapers away from the back panel 100 to a second end point 138 and is about 100 cm long, enough to wrap around the infant more than once, preferably at least twice.

The blanket arms 130, 135 may be separate pieces sewn, bonded, electrically welded, or attached by other means known in the art to sides 102, 104 of the back panel 100, or the blanket arms 130, 135 and the back panel 100 may be of a single, continuous piece of material. The positions of the blanket arms 130, 135 may be reversed in any embodiment of the present invention without impairing the utility of the invention.

In this preferred embodiment of the present invention, the lower edge 131 of the short blanket arm 130 tapers at a more acute angle with respect to the back panel 100 than the upper edge 132 of the short blanket arm 130, so that the first end point 133 is horizontally aligned with the center of the infant's torso. Also, the lower edge 131 of the short blanket arm 130 may curve toward the interior of the arm, eliminating excess material that might bunch and place unwanted pressure on the leg pouch 110. The short blanket arm 130 therefore wraps smoothly and securely around the infant's torso without interfering with leg movement.

The upper edge 137 and the lower edge 136 of the long blanket arm 135 taper at approximately the same angle with respect to the back panel 100, so that the second end point 138 is horizontally aligned with the child's navel. Therefore, when an infant is laid on her back upon the back panel 100 with the tops of her shoulders approximately even with the upper edge 106 of the back panel 100, a straight line between the first end point 133 and the second end point 138 of the extended blanket arms 130, 135 would pass slightly above the infant's navel. In other embodiments of the present invention the upper and lower tapers of the blanket arms 130, 135 may be changed as necessary to effect desired pressure distributions.

The leg pouch 110 is formed from a roughly rectangular piece of fabric that is sewn to the back panel 100 along a first edge 112, a second edge 114, and a bottom edge 118. A typical leg pouch measures approximately 25 cm wide by 30 cm long. The bottom edge 118 of the leg pouch 110 is sewn to the lower edge (not visible) of the back panel 100, leaving the top edge 116 of the leg pouch 110 open. Alternatively, the leg pouch 110 may be an extension of the lower edge of the back panel 100 folded upward and sewn along its vertical edges 112, 114. The vertical edges 112, 114 may also curve inward and outward to form an hourglass profile, allowing somewhat greater restriction of the infant's legs.

The arms restraints 120, 125 are in a preferred embodiment tapered flaps attached to the back panel 100 at seams 121, 126 that lie beneath and parallel to an infant's arms. A typical seam is about 30 cm long. Each arm restraint 120, 125 tapers to a lobe 122, 127 and is positioned so that it may be wrapped inward around an infant's adjacent arm. A typical arm restraint measures about 25 to 30 cm from a seam 121, 126 to the end of a lobe 122, 127. The downwardly-tapering lobes 122, 127 relieve pressure on the infant's shoulders while providing an easily-used means for securing her arms. The lobe shapes minimize fabric bunching and optimize pressure distribution, but the arm restraints 120, 125 may also be triangular, rectangular, or any of a variety of other shapes as desired.

It should be noted that some of the benefits of the present invention may be obtained with a simplified version consisting only of the back panel 100 and tapered long blanket arm 135. The dimensions of the back panel 100 and the taper of the long blanket arm 135 allow a more complete wrap and better pressure distribution than does the traditional colic band. However, addition of the leg pouch 110 protects the infant's feet, simplifies positioning of the infant, and improves containment of the infant's legs. Addition of the arm restraints 120, 125 allows a caregiver to quickly secure an infant's arms close and parallel to the infant's torso. Addition of the short blanket arm 130 allows a caregiver to quickly secure the top edge 116 of the leg pouch 110 and the infant so that the long blanket arm 135 may be easily and carefully wrapped to obtain exactly the desired pressure distribution.

Figure 2A:
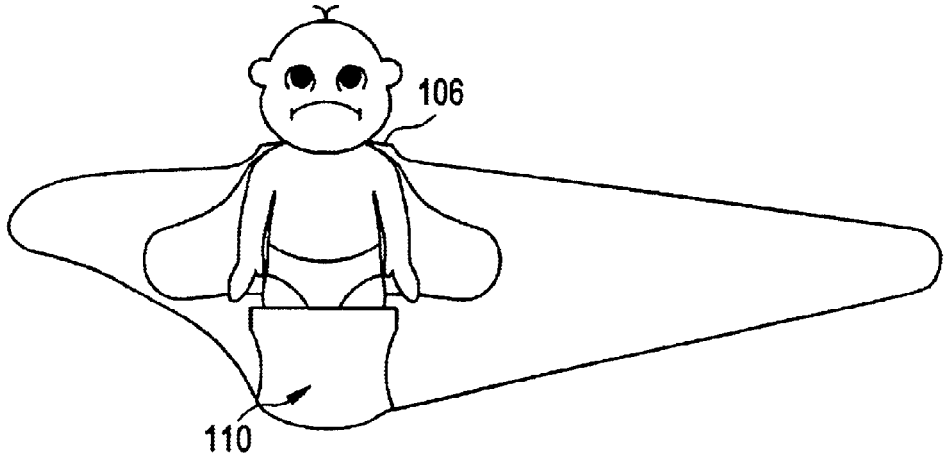
FIG. 2A shows the embodiment of FIG. 1 with an infant whose legs are in the leg pouch.

FIGS. 2A through 2D illustrate a preferred method for employing the present invention. FIG. 2A shows an infant lying on the back panel (not visible) with her shoulders aligned with the upper edge 106 of the back panel, her arms along her sides, and her legs in the leg pouch 110.

Figure 2B:
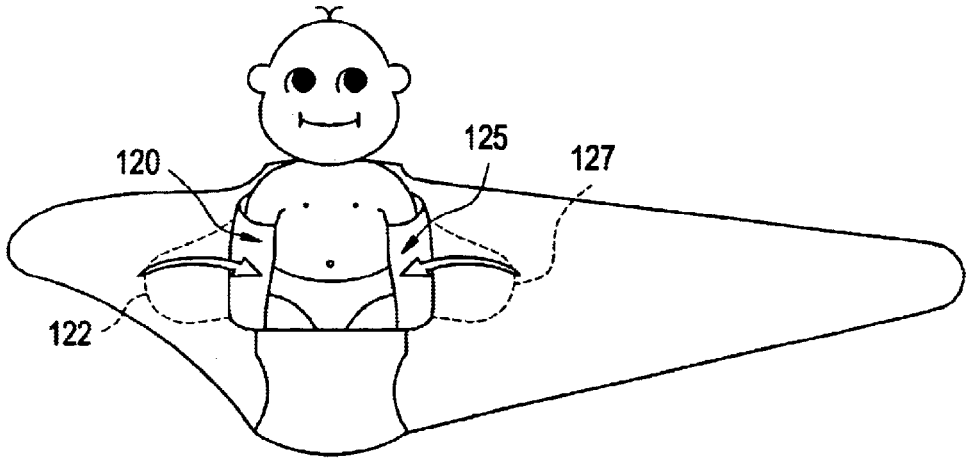
FIG. 2B shows the embodiment of FIG. 1 with arm restraints wrapped around an infant's arms.

FIG. 2B shows how the arm restraints 120, 125 are each wrapped around the outside of an adjacent arm, then inwardly so that the arm restraint lobes 122, 127 can be tucked between the infant's arms and torso, thereby holding the infant's arms in an optimum position while subsequent steps are performed.

Figure 2C:
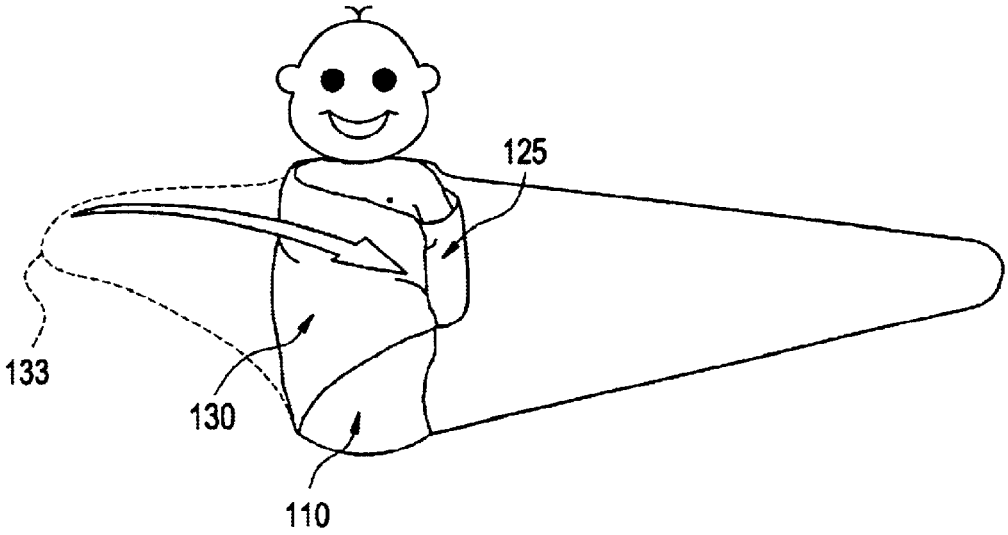
FIG. 2C shows the embodiment of FIG. 1 with a short blanket arm wrapped around an infant's torso and tucked beneath an armpit.

FIG. 2C shows how the short blanket arm 130 is wrapped over and across the infant and secured by tucking the first end point 133 between the infant's torso and the proximate arm restraint 125 and armpit, securing both the top edge (not visible) of the leg pouch 110 and the infant.

Figure 2D:
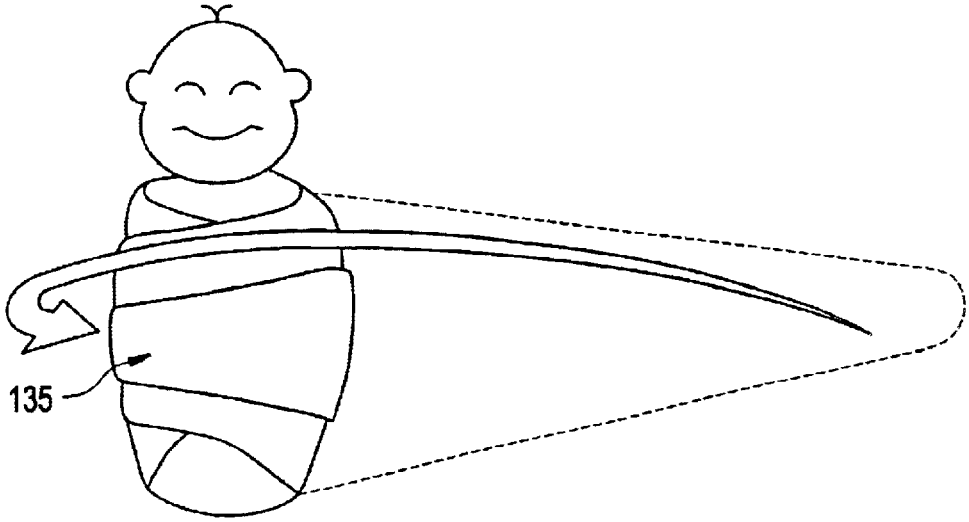
FIG. 2D shows the embodiment of FIG. 1 with a long blanket arm wrapped repeatedly around an infant.

Finally, FIG. 2D shows how the long blanket arm 135 is wrapped over the infant, then repeatedly around the infant until the second end point (not visible) is reached. The caregiver adjusts the tension on the long blanket arm 135 as it is wrapped to obtain the desired pressure on the infant, with the taper of the long blanket arm 135 tending to concentrate increased pressure under the regions wrapped with the most layers. The second end point 138 may be secured by tucking it under a layer of the long blanket arm 135, or by a hook-and-loop or other fastener as is known in the art.

Figure 3:
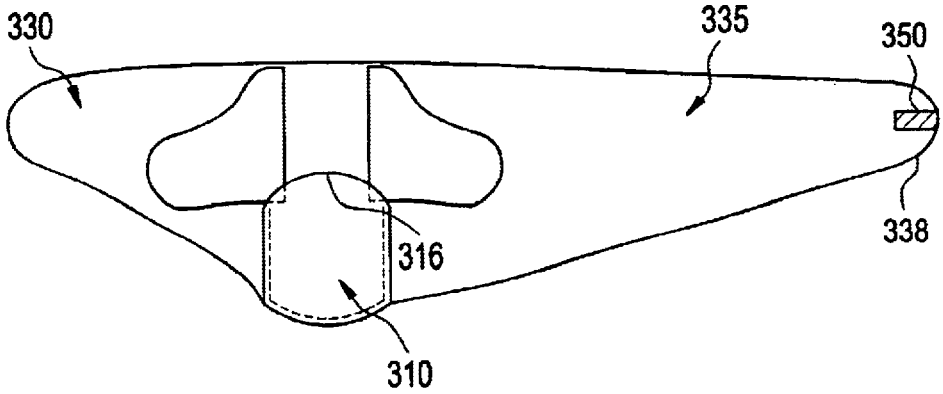
FIG. 3 shows an alternate embodiment of the present invention with an extended leg pouch and a hook-and-loop attachment patch.

FIG. 3 shows an alternate embodiment of the present invention is which the top edge 316 of the leg pouch 310 arcs upward. The extra fabric allows the leg pouch 310 to be better secured by the short blanket arm 330. FIG. 3 also shows an optional hook-and-loop fastener 350 attached to the inner end of the long blanket arm 335 near the second end point 338.

Figure 4:
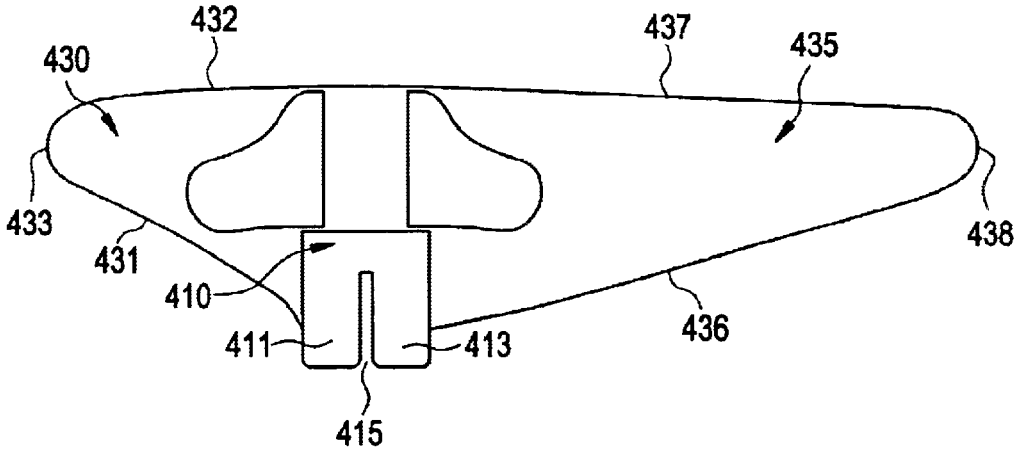
FIG. 4 shows an alternate embodiment of the present invention with a leg pouch divided to accommodate a car seat strap.

FIG. 4 shows another embodiment of the present invention in which the lower portion of the leg pouch 410 is divided into a right leg pouch 411 and a left leg pouch 413, with a gap 415 between to accommodate the buckle of a child's car seat. FIG. 4 also shows a variation on the blanket arm 430, 435 tapers, where the upper edges 432, 437 have very slight tapers and the lower edges 431, 436 have more pronounced tapers, shifting the end points 433, 438 and the corresponding area of maximum pressure upward. This and other variations may be combined with other feature variations described herein.

Figure 5:
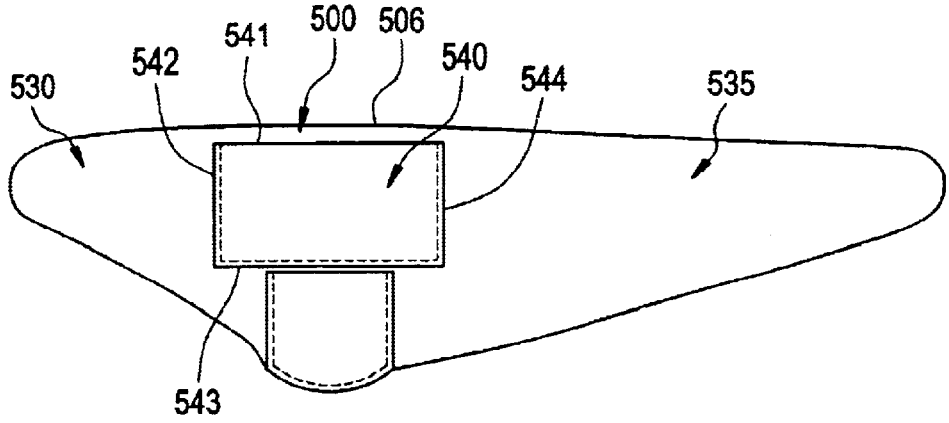
FIG. 5 shows an alternate embodiment of the present invention with a single large arm restraint pouch.

FIG. 5 shows another embodiment of the present invention in which an arm pouch 540 is sewn to the short blanket arm 530 along a side seam 542; to the short blanket arm 530, back panel 500, and long blanket arm 535 along a bottom seam 543; and to the long blanket arm 535 along another side seam 544. The top edge 541 of the arm pouch 540 is left open and is aligned with and slightly below the upper edge 506 of the back panel 500. In use, an infant's arms are inserted into the arm pouch 540 as the infant is laid upon the pouch, then the blanket arms 530, 535 are wrapped in the usual fashion.

Figure 6:
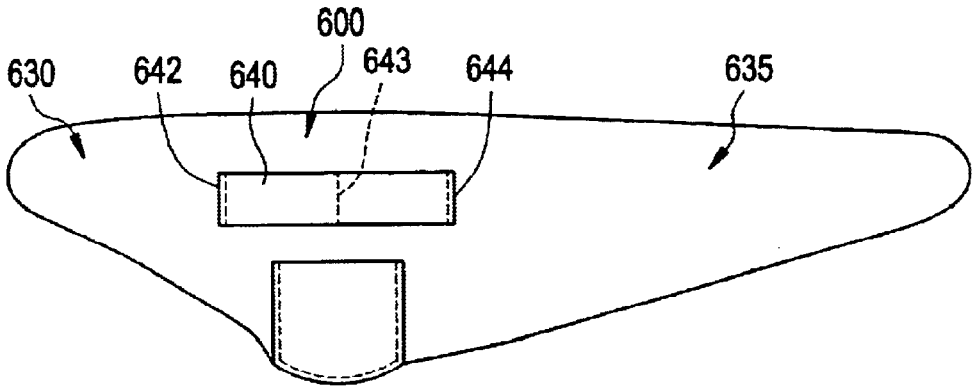
FIG. 6 shows an alternate embodiment of the present invention with a divided arm restraint band.

FIG. 6 shows another embodiment of the present invention in which an arm restraint band 640 is sewn to the short blanket arm 630 along a seam 642; to the back panel 600 along a center seam 643; and to the long blanket arm 635 along another seam 644. In use, an infant's arms are inserted under the arm restraint band 640 on either side of the center seam 643 as the infant is laid upon the band, then the blanket arms 630, 635 are wrapped in the usual fashion.

Figure 7:
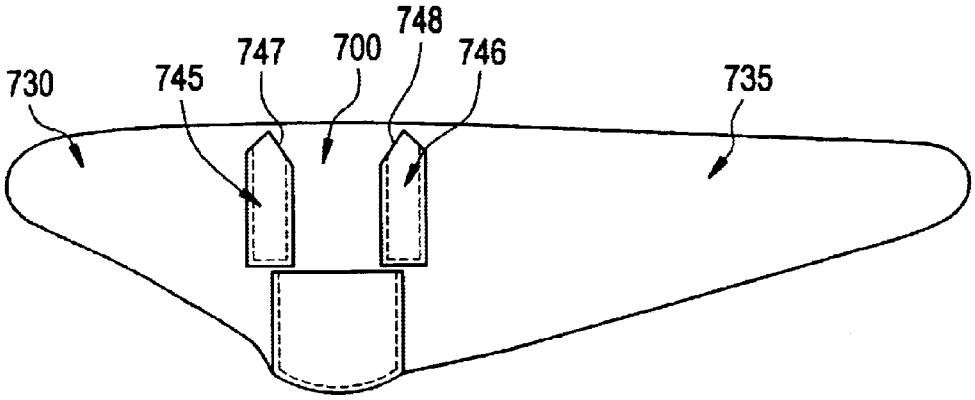
FIG. 7 shows an alternate embodiment of the present invention with two narrow arm restraint pouches.
Figure 8:
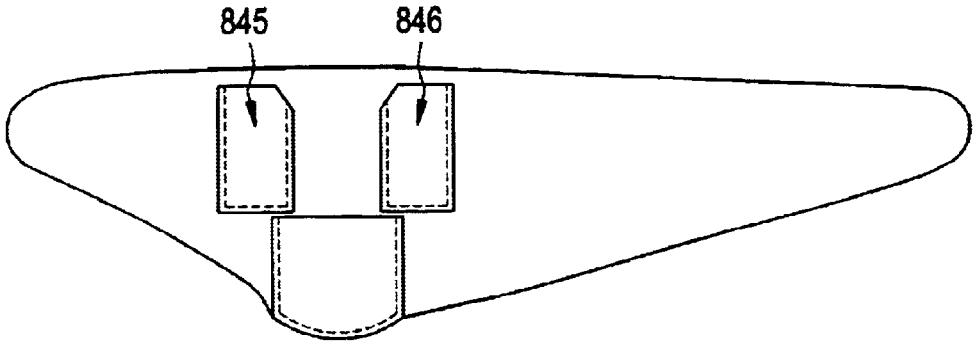
FIG. 8 shows an alternate embodiment of the present invention with two wide arm restraint pouches.

FIG. 7 shows an embodiment of the present invention with separate arm pouches. A right arm pouch 745 is sewn to the short blanket arm 730 and the back panel 700, leaving open an upper edge 747. A left arm pouch 746 is sewn to the long blanket arm 735 and the back panel 700, leaving open an upper edge 748. In use, each of an infant's arms is inserted into an adjacent arm pouch 745, 746 as the infant is laid upon the back panel 700, then the blanket arms 730, 735 are wrapped in the usual fashion. FIG. 8 shows an embodiment of the present invention substantially the same as that shown in FIG. 7, but with larger arm pouches 845, 846.

The principles, embodiments, and modes of operation of the present invention have been set forth in the foregoing specification. The embodiments disclosed herein should be interpreted as illustrating the present invention and not as restricting it. The foregoing disclosure is not intended to limit the range of equivalent structure available to a person of ordinary skill in the art in any way, but rather to expand the range of equivalent structures in ways not previously contemplated. Numerous variations and changes can be made to the foregoing illustrative embodiments without departing from the scope and spirit of the present invention.

I claim:

1. A swaddling blanket, comprising:

a back panel, the back panel having a top edge, a bottom edge, a first side, and a second side; and a first blanket arm, the first blanket arm having a top edge, a wide end, and a narrow end, the wide end of the first blanket arm being integrated with the first side of the back panel to form a continuous sheet, the top edge of the back panel extending fewer than three centimeters above the top edge of the first blanket arm.

2. A swaddling blanket as claimed in claim 1, additionally comprising a leg pouch, the leg pouch having a bottom edge, the leg pouch being disposed upon the back panel with the bottom edge of the leg pouch proximate to the bottom edge of the back panel.

3. A swaddling blanket as claimed in claim 1, additionally comprising an arm restraint, the arm restraint disposed upon the back panel.

4. A swaddling blanket as claimed in claim 1, additionally comprising a first arm restraint and a second arm restraint, the arm restraints disposed upon the back panel.

5. A swaddling blanket as claimed in claim 1, additionally comprising a second blanket arm, the second blanket arm having a wide end and a narrow end, the wide end of the second blanket arm being integrated with the second side of the back panel to form a continuous sheet.

6. A swaddling blanket as claimed in claim 5, wherein the second blanket arm is shorter than the first blanket arm.

7. A swaddling blanket, comprising:

a back panel, the back panel having a bottom edge, a first side, and a second side;

a leg pouch, the leg pouch having a top edge and a bottom edge, the leg pouch being disposed upon the back panel with the bottom edge of the leg pouch proximate to the bottom edge of the back panel;

a first arm restraint and a second arm restraint, the arm restraints disposed upon the back panel above the top edge of the leg pouch;

a first blanket arm, the first blanket arm having a wide end and a narrow end, the wide end of the first blanket arm being integrated with the first side of the back panel to form a continuous sheet, the first blanket arm being long enough to wrap entirely around an infant at least twice; and a second blanket arm, the second blanket arm having a wide end and a narrow end, the wide end of the second blanket arm being integrated with the second side of the back panel to form a continuous sheet, the second blanket arm being long enough to span an infant's torso and wide enough to overlap the top edge of the leg pouch.

8. A method for swaddling an infant, comprising the steps of:

laying the infant upon a swaddling blanket, with the infant facing upward;

inserting the infant's legs in a leg pouch attached to the swaddling blanket;

restraining the infant's arms close and parallel to the infant's torso;

wrapping a second blanket arm across the infant; and wrapping a first blanket arm around the infant in a direction opposite the direction in which the second blanket arm was wrapped.

9. A swaddling blanket, comprising:

a back panel, the back panel having a bottom edge, a first side, and a second side;

a first blanket arm, the first blanket arm having a wide end and a narrow end, the wide end of the first blanket arm being integrated with the first side of the back panel to form a continuous sheet, the first blanket arm being long enough to wrap entirely around an infant at least twice; and a leg pouch, the leg pouch having a bottom edge, the leg pouch being disposed upon the back panel with the bottom edge of the leg pouch proximate to the bottom edge of the back panel.

10. A swaddling blanket, comprising:

a back panel, the back panel having a bottom edge, a first side, and a second side;

a first blanket arm, the first blanket arm having a wide end and a narrow end, the wide end of the first blanket arm being integrated with the first side of the back panel to form a continuous sheet, the first blanket arm being long enough to wrap entirely around an infant at least twice; and an arm restraint, the arm restraint disposed upon the back panel.

11. A swaddling blanket, comprising:

a back panel, the back panel having a bottom edge, a first side, and a second side;

a first blanket arm, the first blanket arm having a wide end and a narrow end, the wide end of the first blanket arm being integrated with the first side of the back panel to form a continuous sheet, the first blanket arm being long enough to wrap entirely around an infant at least twice; and a first arm restraint and a second arm restraint, the arm restraints disposed upon the back panel.

12. A swaddling blanket, comprising:

a back panel, the back panel having a bottom edge, a first side, and a second side;

a first blanket arm, the first blanket arm having a wide end and a narrow end, the wide end of the first blanket arm being integrated with the first side of the back panel to form a continuous sheet; and an arm restraint, the arm restraint disposed upon the back panel.

13. A swaddling blanket, comprising:

a back panel, the back panel having a bottom edge, a first side, and a second side;

a first blanket arm, the first blanket arm having a wide end and a narrow end, the wide end of the first blanket arm being integrated with the first side of the back panel to form a continuous sheet; and a first arm restraint and a second arm restraint, the arm restraints disposed upon the back panel.

14. A swaddling blanket, comprising:

a back panel, the back panel having a bottom edge, a first side, and a second side;

a leg pouch, the leg pouch having a top edge and a bottom edge, the leg pouch being disposed upon the back panel with the bottom edge of the leg pouch proximate to the bottom edge of the back panel, the leg pouch divided to accommodate a restraint member;

a first arm restraint and a second arm restraint, the arm restraints disposed upon the back panel above the top edge of the leg pouch;

a first blanket arm, the first blanket arm having a wide end and a narrow end, the wide end of the first blanket arm being integrated with the first side of the back panel to form a continuous sheet, the first blanket arm being long enough to wrap entirely around an infant at least twice; and a second blanket arm, the second blanket arm having a wide end and a narrow end, the wide end of the second blanket arm being integrated with the second side of the back panel to form a continuous sheet, the second blanket arm being long enough to span an infant's torso and wide enough to overlap the top edge of the leg pouch.

15. A swaddling blanket, comprising:

a back panel, the back panel having a bottom edge, a first side, and a second side;

a leg pouch, the leg pouch having a top edge and a bottom edge, the leg pouch being disposed upon the back panel with the bottom edge of the leg pouch proximate to the bottom edge of the back panel;

a first arm restraint and a second arm restraint, the arm restraints disposed upon the back panel above the top edge of the leg pouch, each arm restraint comprising a pouch;

a first blanket arm, the first blanket arm having a wide end and a narrow end, the wide end of the first blanket arm being integrated with the first side of the back panel to form a continuous sheet, the first blanket arm being long enough to wrap entirely around an infant at least twice; and a second blanket arm, the second blanket arm having a wide end and a narrow end, the wide end of the second blanket arm being integrated with the second side of the back panel to form a continuous sheet, the second blanket arm being long enough to span an infant's torso and wide enough to overlap the top edge of the leg pouch.

16. A swaddling blanket, comprising:

a back panel, the back panel having a bottom edge, a first side, and a second side;

a leg pouch, the leg pouch having a top edge and a bottom edge, the leg pouch being disposed upon the back panel with the bottom edge of the leg pouch proximate to the bottom edge of the back panel;

an arm restraint, the arm restraint disposed upon the back panel above the top edge of the leg pouch, the arm restraint comprising a pouch wide enough to contain the arms of an infant lying on the pouch with the arms of the infant disposed on either side of the infant's torso;

a first blanket arm, the first blanket arm having a wide end and a narrow end, the wide end of the first blanket arm being integrated with the first side of the back panel to form a continuous sheet, the first blanket arm being long enough to wrap entirely around an infant at least twice; and a second blanket arm, the second blanket arm having a wide end and a narrow end, the wide end of the second blanket arm being integrated with the second side of the back panel to form a continuous sheet, the second blanket arm being long enough to span an infant's torso and wide enough to overlap the top edge of the leg pouch.

* * * * *